US007565991B2

(12) United States Patent
Erhardt

(10) Patent No.: US 7,565,991 B2
(45) Date of Patent: Jul. 28, 2009

(54) HAND-HELD DRIVE-IN TOOL

(75) Inventor: Rolf Erhardt, Buchs (CH)

(73) Assignee: Hilti Aktiengesellschaft, Schann (LI)

( * ) Notice: Subject to any disclaimer, the term of this patent is extended or adjusted under 35 U.S.C. 154(b) by 92 days.

(21) Appl. No.: 11/975,675

(22) Filed: Oct. 18, 2007

(65) Prior Publication Data

US 2008/0099528 A1 May 1, 2008

(30) Foreign Application Priority Data

Oct. 27, 2006 (DE) ..... 10 2006 035 370

(51) Int. Cl.
*B25C 1/06* (2006.01)

(52) U.S. Cl. ..... 227/8; 227/2; 227/10; 227/156

(58) Field of Classification Search ..... 227/8, 227/10, 130, 2, 132, 156
See application file for complete search history.

(56) References Cited

U.S. PATENT DOCUMENTS 3,022,509 A * 2/1962 De Man ..... 227/109
3,060,435 A * 10/1962 Ivins et al. ..... 227/11
3,661,312 A * 5/1972 Pomernacki ..... 227/8
4,323,127 A * 4/1982 Cunningham ..... 173/53
4,573,621 A * 3/1986 Merkator et al. ..... 227/8
4,630,766 A * 12/1986 Steeves et al. ..... 227/8
4,946,087 A * 8/1990 Wingert ..... 227/131
5,366,132 A * 11/1994 Simonelli ..... 227/8
5,511,715 A * 4/1996 Crutcher et al. ..... 227/131
5,683,024 A * 11/1997 Eminger et al. ..... 227/8
6,045,024 A * 4/2000 Phillips ..... 227/130
6,145,727 A * 11/2000 Mukoyama et al. ..... 227/130
6,179,192 B1 * 1/2001 Weinger et al. ..... 227/8
6,672,498 B2 * 1/2004 White et al. ..... 227/120
6,830,173 B2 * 12/2004 Barber et al. ..... 227/131
7,090,107 B2 * 8/2006 Buechel et al. ..... 227/8

* cited by examiner

*Primary Examiner*—Scott A. Smith
(74) *Attorney, Agent, or Firm*—Abelman, Frayne & Schwab

(57) ABSTRACT

A hand-held drive-in tool for driving fastening elements, includes a driving ram (13) displaceably arranged in a guide (12), a drive unit (14) for displacing the driving ram (13), a press-on element (20) for controlling the safety element (23) of the drive unit (14) and spring-biased in a drive-in direction, and a device for changing a biasing force applied to the press-on element (20) dependent on a special orientation of the press-on element (20) relative to a vector (G) of a gravitational force.

7 Claims, 3 Drawing Sheets

HAND-HELD DRIVE-IN TOOL

BACKGROUND OF THE INVENTION

1. Field of the Invention

The present invention relates to a hand-held drive-in tool for driving fastening elements and including a guide, a driving ram for driving fastening elements such as, e.g., nails or bolts, in a workpiece and displaceably arranged in the guide, a drive unit for displacing the driving ram and having a safety element, a press-on element for controlling the safety element of the drive unit, and spring means for biasing the press-on element in a drive-in direction.

2. Description of the Prior Art

The drive unit of the drive-in tool of the type described above can be formed as a mechanical, electrical, pneumatic unit or be operated by combustion power.

U.S. Pat. No. 4,375,867 discloses a drive-in tool of the type described above. The drive-in tool includes a driving ram for driving in nails and which is advanced by an electrically operated solenoid. The safety device includes a stirrup spring with a control cam surface for engaging a projection provided on a trigger switch. The spring is formed at an end of a rod-shaped press-on element displaceable in a guide located in the housing of the drive-in tool. The spring serves as a safety element that provides for actuation of the trigger for initiating of the setting process only then when the drive-in tool is pressed with its mouth against a workpiece. The displaceable press-on is resiliently supported in the housing by the stirrup spring.

The drawback of the known drive-in tool consists in that the biasing force with which the press-on element is biased out of the housing, i.e., in the drive-in direction is always the same, independent of the orientation of the drive-in tool relative to the gravity force, i.e., when the drive-in tool is oriented with its mouth in the direction of the gravity force (e.g., for driving nails into a floor), and when the drive-in tool is oriented with its mouth in a direction opposite the direction of action of the gravity force (e.g., for driving nails into a ceiling). At driving of nails in the direction of gravity force, it is easier to overcome the gravity force because the mass of the drive-in tool contributes to overcoming of the gravity force, whereas at driving nails in the opposite direction, the press-on force should be noticeably greater because additionally to overcoming the gravity force, the mass of the drive-in tool should also be displaced in a direction opposite the direction of action of the gravity force.

The object of the present invention is to modify a drive-in tool of the type discussed above so that the above-mentioned drawback of the known tool is eliminated, and that a relatively uniform press-on force needs to be applied thereto independent of the orientation of the drive-in tool relative to the vector of the gravity force.

SUMMARY OF THE INVENTION

This and other objects of the present invention, which will become apparent hereinafter, are achieved by providing in the drive-in tool of the type described above means for changing a biasing force applied by the spring means to the press-on element dependent on a particular orientation of the press-on element relative to a vector of a gravitation force of the drive-in tool By changing the biasing force applied to the press-on element, it is achieved that essentially the same press-on force needs to be applied by the user, independent of the orientation of the drive-in tool, whether it is oriented in the direction of the ceiling (opposite the gravitational force), horizontally (transverse to the gravitational force), in the direction of the gravitational force, or in any direction therebetween.

Advantageously, the biasing force changing means is formed as switch means an operation of which depends on the special orientation of the press-on element. In this case, adjustment takes place automatically, with the gravitational force controlling the adjustment of the biasing force. In an easily manufactured embodiment, the switch means is formed as an inclination switch controlled by the gravitational force.

In a particularly convenient embodiment, the switch means is formed as an electronic inclination switch that can accommodate the smallest changes of the orientation of the drive-in tool relative to the vector of the gravity force.

In a cost-effectively manufactured embodiment of the inventive drive-in tool, the switch means is formed as a pendulum-like mechanical inclination switch.

In a simple and technically easily adjustable embodiment of the inventive drive-in tool, the spring means is formed of at least two springs at least one of which is linked up and breaks off relative to the press-on element by the inclination switch. Thereby, at least two stages of the biasing force for the press-on element are provided.

Advantageously, the spring means is formed of at least one spring and the drive-in tool includes means for preloading the at least one spring against the press-on element and which is controlled by the inclination switch. This ensures almost stepless regulation of the biasing force of the spring.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
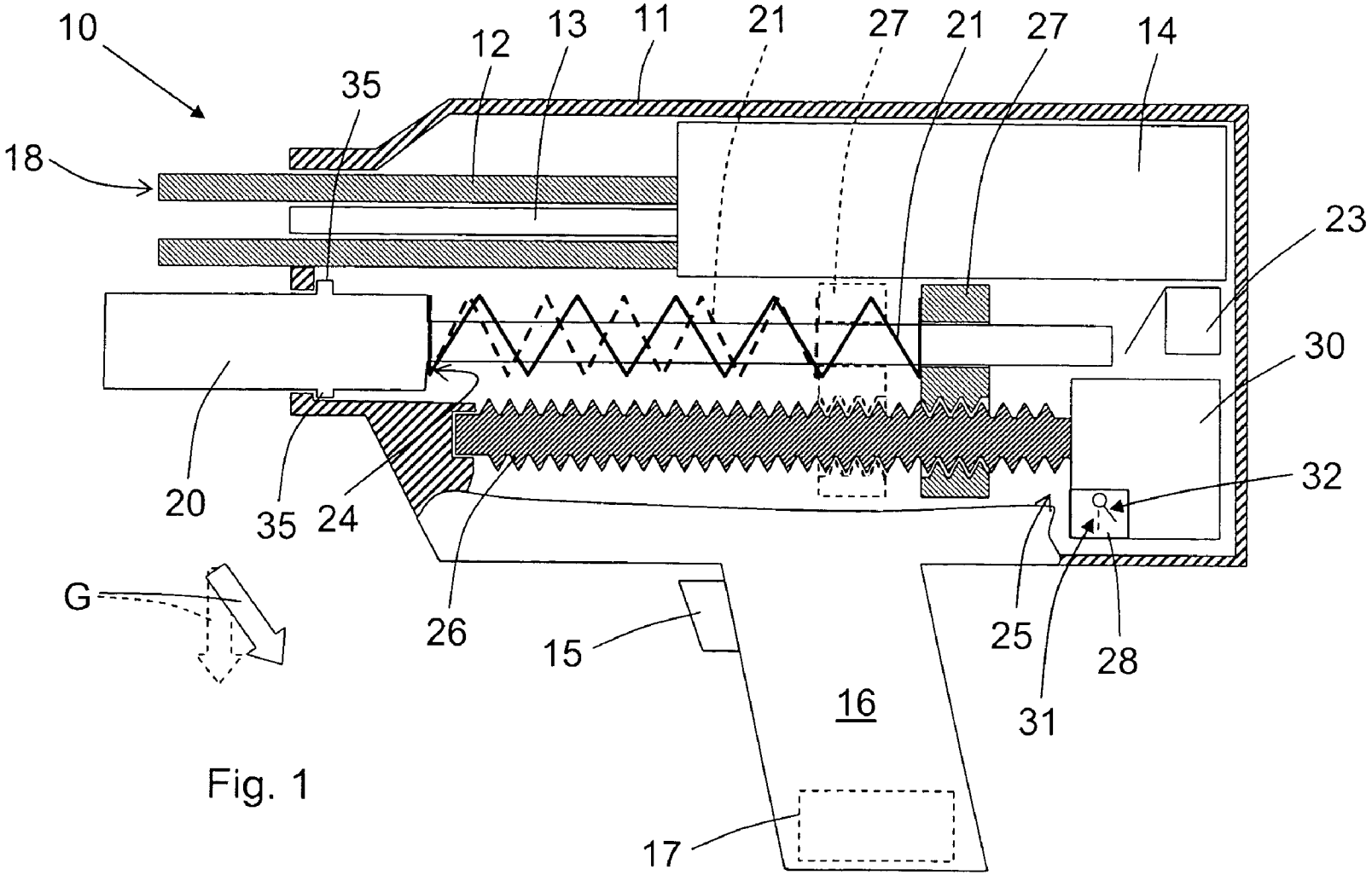
FIG. 1 a longitudinal cross-sectional view of a drive-in tool according to the present invention in an initial position thereof.

A drive-in tool 10 according to the present invention, which is shown in FIG. 1, has a housing 11 and a drive unit for driving a ram 13 and which is arranged in the housing 11 and is generally designated with a reference numeral 14. The driving ram 13 is displaceably arranged in a guide 12 in which a fastening element (not shown in the drawings) such as nail or bolt, can be brought and placed in front of the free end of the driving ram 13 for being driving with the driving ram 13 in a workpiece during a setting process. For initiating such setting process, an actuation switch 15 is provided on a handle 16 of the power tool 10 and is actuated manually for starting the setting process.

A fastening element magazine, in which fastening elements can be stored, can project sidewise from the drive-in tool 10 in the region of the tool mouth 18. In the embodiment shown in the drawings, the drive unit 14 is electrically driven and has a magnetic coil, not shown, for driving the driving ram 13. The supply of the drive-in tool 10 with electrical energy is effected from a power source 17 that is, e.g., network-independent and contains, e.g., batteries or accumulators. The power source 17 is connected with both the drive unit 14 and the actuation switch 15 and other electrical consumers by electrical feeding or control conductors, not shown.

The drive unit 14 can be driven alternatively to the method described above, by electrically driven flywheel or a spring mechanism, pneumatically, or with combustion power.

The drive-in tool 10 is further provided with a rod-shaped press-on element 20 that extends from the housing 11 in the region of the tool mouth 18 and is displaceable along its longitudinal axis. The press-on element 20 is biased by a spring 21 in the direction of its partially extending, from the housing, position, as shown in FIG. 1. A projection 35, which is provided on the press-on element 20, defines the maximal extending from the tool housing 11, position of the press-on element 20 relative to the mouth side of the housing 11. The spring 21 is supported, on the one hand, against a stop 24 on the press-on element 20 and, on the other hand, against a preloading element 27 that forms part of a preloading device for the spring 21, which is generally designated with a reference numeral 25. In order for the setting process to be actuated with the actuation switch 15, first, the drive-in tool 10 should be pressed against a workpiece so that the press-on element 20 is displaced against the biasing force of the spring 21 so far in the direction of the housing 11 that the mouth 18 of the guide 12 directly abuts the workpiece. When the press-on element 20 is displaced that far, then the safety element, which is formed as a safety switch, is actuated, releasing the actuation switch 15.

For changing the preload of the first spring 21, the above-mentioned preloading device 25 is arranged on the drive-in tool 10. The preloading device 25 includes, in addition to the preloading element 27, which is displaceable relative to the press-on element 20, a servomotor 30 for driving a gear shaft 26. The servomotor 30 is controlled by an electronic control inclination switch 28 the position of which corresponds to the changes of the orientation of the drive-in tool 10 relative to the vector G of the gravity force. In FIG. 1, the vector G of the gravitational force is shown with an arrow indicating the orientation of the drive-in tool 10. In the first orientation position of the drive-in tool 10 (shown with a solid arrow G), the drive-in tool 10 is slightly inclined relative to the vector G of the gravitational force (the mouth 18 of the drive-in tool 10 is inclined slightly upward). With this orientation of the drive-in tool 10 to the vector G of the gravitational force, the electronic inclination switch 8 is located in a first position 31 (or a plurality of possible positions), whereby the servomotor 30 has displaced the preloading element 27 in the position shown in FIG. 1 (with the preloading element 27 shown with solid line) at a slight preload of the first spring 21.

If the drive-in tool 10 is brought in a perpendicular orientation (relative to its longitudinal extension), which is shown with dashed arrow G, relative to the vector G of the gravitational force, then the electronic inclination switch 28 occupies the second position 32 shown with dash lines. As a result, the servomotor 30 displaces, with the gear shaft 26, the preloading element 27 in the position shown in FIG. 1 with dash lines, in which preloading of the spring 21 is greater then with the previously described orientation of the drive-in tool 10. However, for the user, the applied press-on force remains in both cases substantially the same. This is because with the first orientation of the drive-in tool 10, which was discussed above, to the smaller biasing force of the first spring 21, which results from its smaller preload, a greater force is applied for compensating the inclined orientation relative to the vector G of the gravitational force. In the second position of the drive-in tool 10, which has a second orientation, the applicable force is smaller.

Figure 2:
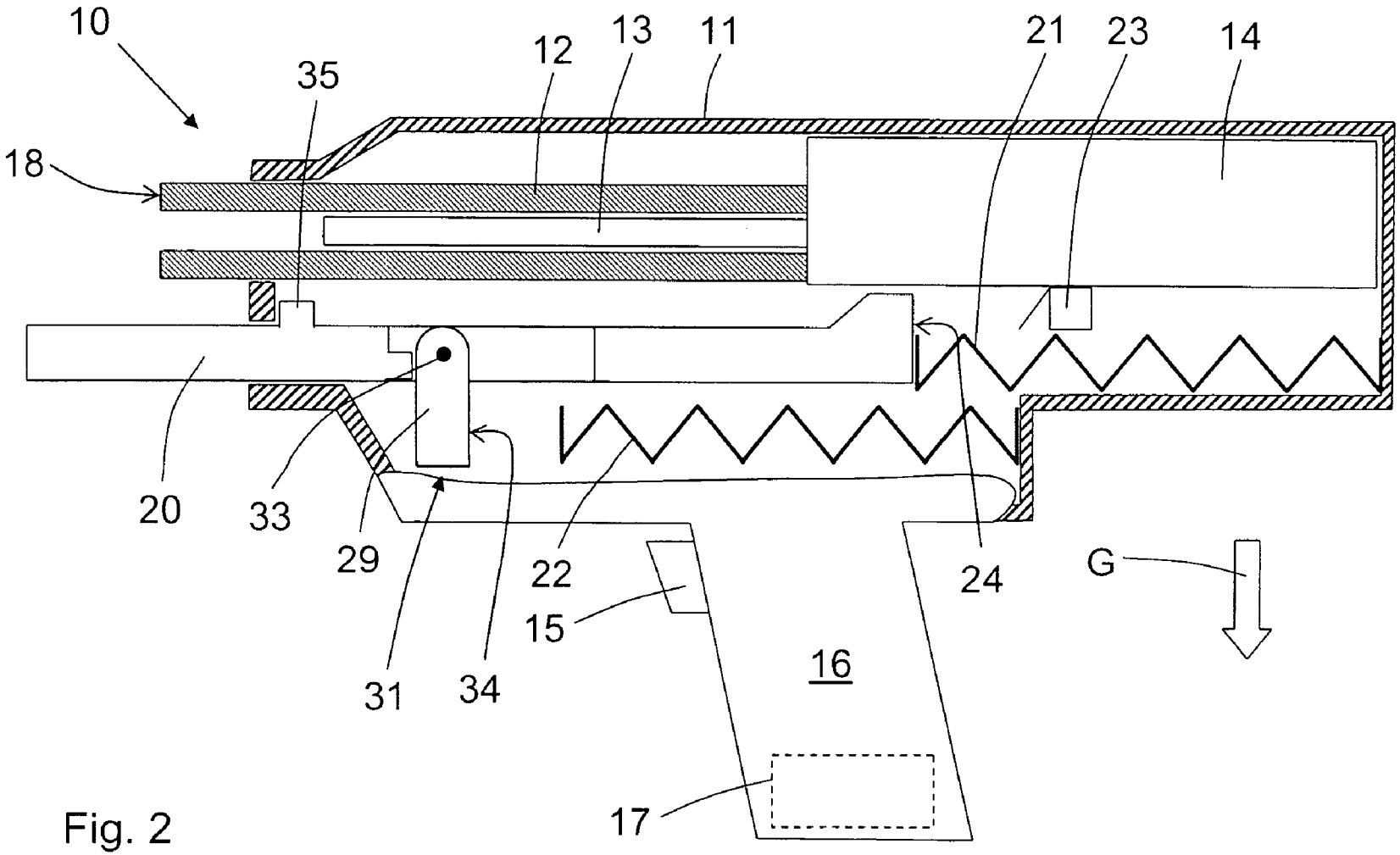
FIG. 2 a longitudinal cross-sectional view of another embodiment of a drive-in tool according to the present invention in an initial position thereof with a first orientation with respect to the vector of the gravity force.
Figure 3:
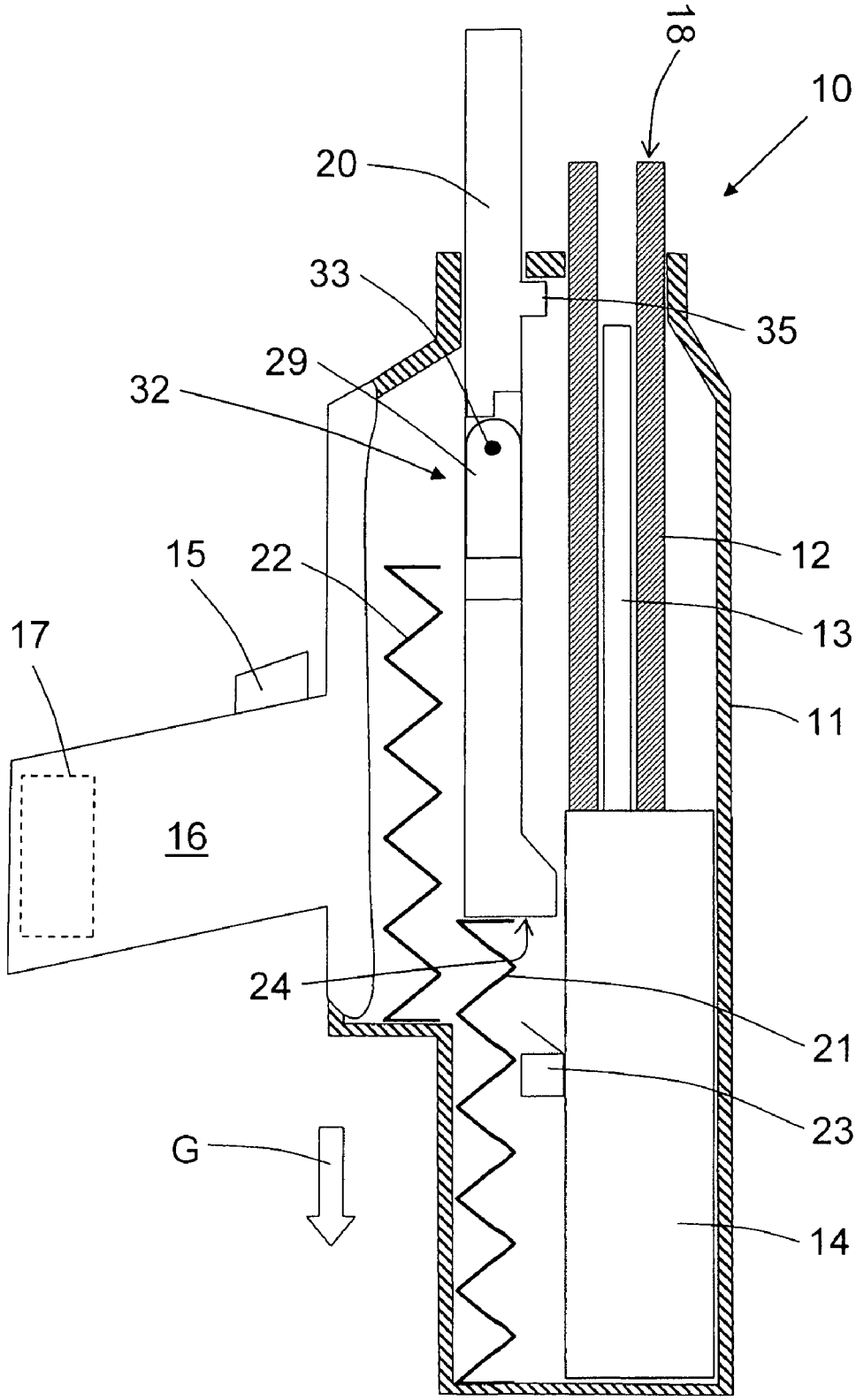
FIG. 3 a longitudinal cross-sectional view of the drive-in tool shown in FIG. 2 in the initial position thereof and with a second orientation with respect to the gravity force.

A drive-in tool 10, which is shown in FIGS. 2-3, differs from that shown in FIG. 1 in that instead of the preloading device, there is provided a second, orientation-dependent, add-on spring 22 the addition of which to/disconnection from the first spring 21 or to/from the press-on element 20 is effected with pendulum-like mechanical inclination switch 29. The mechanical inclination switch 29 is formed as a pivotable pendulum element supported on a pivot support 33 provided on the press-on element 20. The switch 29 has a stop surface 34 that supports the second spring 22. Both springs 21, 22 are fixed to the housing 11 at their respective ends remote from the press-on element 20. With the orientation (horizontal) of the drive-in tool 10 shown in FIG. 2, the drive-in tool extends, with its longitudinal extension transverse to the vector G of the gravitation force. The mechanical inclination switch 29 assumes, under gravitational force control, an orientation transverse to the longitudinal extent of the press-on element 20 or the drive-in tool 10 and is located, thereby, in the axial projection of the second spring 22. When the drive-in tool 10 is pressed in this position against a work piece, the press-on element 20 would first be displaced in the housing 11 against the force of the first spring 21. Only after the press-on element 20 has been displaced over about a half of its displacement path, the mechanical inclination switch 29 would engage, with its stop surface 34, the free end of the second spring 22, which increases the pressure force to be applied by the user.

In FIG. 3, the drive-in tool 10 is oriented with its mouth 18 in a direction precisely opposite the vector G of the gravitational force (vertical orientation of the drive-in tool 10). With this orientation of the drive-in tool 10, the mechanical inclination switch 29 is oriented under gravitational force control parallel to the longitudinal extension of the press-on element 20 and is not located in the axial projection of the second spring 22. When the drive-in tool 10 is pressed against a workpiece of a ceiling, the press-on element 20 is displaced only against the biasing force of the first spring 21. The user, however, again needs to apply approximately the same press-on force as at the orientation of the drive-in tool 10 shown in FIG. 2.

With respect to other reference numerals shown in FIGS. 2-3 but not discussed in detail in the discussion of the structure shown in these figures, the reference should be made to the description of FIG. 1 discussed in detail above.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving fastening elements, comprising a guide (12); a driving ram (13) displaceably arranged in the guide (12); a drive unit (14) for displacing the driving ram (13) and having a safety element (23); a press-on element (20) for controlling the safety element (23) of the drive unit (14); spring means for biasing the press-on element (20) in a drive-in direction; and means for changing a biasing force applied by the spring means to the press-on element (20) dependent on a special orientation of the press-on element (20) relative to a vector (G) of a gravitational force of the drive-in tool.

2. A drive-in tool according to claim 1, wherein the biasing force changing means comprises switch means an operation of which depends on a particular orientation of the press-on element (20).

3. A drive-in tool according to claim 2, wherein the switch means comprises an inclination switch (28, 29) controlled by the gravitational force.

4. A drive-in tool according to claim 3, wherein the spring means comprises at least two springs (21, 22) at least one of which (22) is linked up and breaks off relative to the press-on element (20) by the inclination switch (29).

5. A drive-in tool according to claim 3, wherein the spring means comprises at least one spring (21); the drive-in tool includes means (25) for preloading the at least one spring (21) against the press-on element (20) and which is controlled by the inclination switch (28).

6. A drive-in tool according to claim 2, wherein the switch means comprises an electronic inclination switch (28).

7. A drive-in tool according to claim 2, wherein the switch means comprises a mechanical inclination switch (29).

* * * * *